US005432411A

United States Patent [19]

Beeteson et al.

[11] Patent Number: 5,432,411

[45] Date of Patent: Jul. 11, 1995

[54] ELECTRIC FIELD EMISSION REDUCTION APPARATUS

[75] Inventors: John Beeteson, Skelmorie; Andrew Knox, Kilbirnie, both of United Kingdom

[73] Assignee: International Business Machines Corporation, Armonk, N.Y.

[21] Appl. No.: 220,990

[22] Filed: Mar. 31, 1994

[30] Foreign Application Priority Data

Oct. 30, 1993 [GB] United Kingdom ..... 9322413

[51] Int. Cl.[6] ..... H01J 29/56

[52] U.S. Cl. ..... 315/370; 315/8; 315/85

[58] Field of Search ..... 315/8, 85, 370; 361/150

[56] References Cited

U.S. PATENT DOCUMENTS 5,151,635 9/1992 Cappels .
5,198,729 3/1993 Powell ..... 315/370
5,243,262 9/1993 Moen ..... 315/370

FOREIGN PATENT DOCUMENTS

523741A1 7/1992 European Pat. Off. .

*Primary Examiner*—Theodore M. Blum
*Attorney, Agent, or Firm*—Ronald L. Drumheller

[57] ABSTRACT

The present electrical apparatus comprises an antenna for directing towards an electric field source to detect the electric field (E) to be reduced. The antenna is connected to amplifier for generating an output signal in response to an input signal from the antenna. The output signal is in anti-phase to the input signal. A radiator is connected to the amplifier for radiating a cancelling electric field (E′) in anti-phase to the electric field (E) from the source in response to the output signal from the amplifier to at least partially cancel reduce the electric field from the source. The antenna, when directed towards the source, is positioned relative to the radiator and the source to detect both the cancelling electric field (E′) from the radiator and the electric field (E) from the source. The input signal produced by the antenna is thus derived from the sum of the electric field (E) to be reduced from the source and the cancelling electric field (E′) from the radiator.

21 Claims, 3 Drawing Sheets

ELECTRIC FIELD EMISSION REDUCTION APPARATUS

FIELD OF THE INVENTION

The present invention relates to apparatus for reducing electric field emissions by the application of cancellation fields.

BACKGROUND OF THE INVENTION

A conventional raster scanned cathode ray tube (CRT) display such as a television receiver or a computer visual display unit comprises circuitry that can generate electric fields of sufficient strength to radiate beyond the display. Various studies have raised public concern about these electric fields and the possible health hazards associated with them. As a result of these concerns various standards have been introduced defining maximum emission levels which products claiming to meet these standards can emit. In Northern Europe, for example, products can be tested to a standard developed and administered by TCO, the Swedish Confederation of Professional Employees. To meet a part of this standard, true RMS values of emissions in the frequency band from 2 kHz to 400 kHz are measured and must be less than 1 Volt/meter.

A CRT display typically comprises horizontal and vertical electromagnetic deflection coils arranged on a yoke mounted around the neck of the CRT. In operation, currents having a sawtooth waveform flow through the coils to scan the electron beam or beams across the CRT screen in a raster pattern. The voltages across the deflection coils reach a peak during the retrace or flyback period of the sawtooth currents. The peak voltage signals have a large component of harmonics of the corresponding deflection frequencies.

The electron beam or beams are accelerated from the neck of the CRT towards the screen by a "final anode" or Extra High Tension (EHT) voltage of typically 25 kV for a colour display. The flow of electrons is referred to as "beam current". The EHT voltage is typically generated from a step up transformer synchronised to the line scan. In displays having integrated horizontal deflection circuits and EHT generation, the voltage pulse signal driving the primary of the transformer is derived from the peak voltage across the horizontal deflection coil. In displays having separate EHT generation and horizontal deflection circuits, the voltage pulse signal is generated separately from the line scan signal, but may be synchronised to it, although not necessarily in phase.

The output impedance of the EHT generator is sufficiently high that changes in beam current loading through screen content cause modulation of the EHT voltage. This is the primary source of radiated electric fields in front of the display. This modulation of the internal CRT final anode voltage is coupled through the CRT faceplate and transmitted through the intervening medium (air in this case) to the observation point.

Electric field emissions from CRT displays can be reduced at the sides and back by enclosing the radiating conductors with grounded metal screens, and this is normal for multi-frequency displays. The screening necessary to reduce the emissions in front of the display is usually in the form of a conductive optical panel which is transparent to the light emitted by the CRT panel. The screen image is viewed through the panel which can diminish image quality. In addition, these panels are expensive to manufacture.

U.S. Pat. No. 5,151,635 describes an apparatus and method of reducing these time varying electric fields by providing a cancellation field of equal magnitude but opposite polarity to those generated by the horizontal deflection circuit, degaussing circuit and other circuits along with radiating antennae for each of these cancellation fields.

European Patent Application 0 523 741 describes a similar apparatus which senses the electric field associated with the deflection yoke and provides a signal to a radiating antennae.

For displays having integrated EHT generation and horizontal deflection circuits, the electric field sensed from the deflection circuit is similar to the actual electric field emitted from the display and so some cancellation of the primary source of radiated electric fields in front of the display is achieved. However, for displays having separate EHT generation and horizontal deflection circuits, such a system may not achieve cancellation of the field since although the two circuits are usually, but not always, synchronised, they may be distanced from each other in phase.

Prior art methods of using cancellation fields to reduce electric field emissions have used either combined EHT generation and horizontal deflection circuits or separate circuits, but with the circuits in phase as well as synchronised. For these monitors the use of a signal from the horizontal deflection circuit to control the cancellation field provided some reduction in field emissions, but the fact that the primary source of radiated electric fields from the front of the display was the modulation of the internal CRT final anode voltage was not apparent due to the in-phase synchronous nature of the two circuits.

It is advantageous to sense this modulation directly and to provide cancellation based on this modulation rather than based on the horizontal deflection circuit. Even though the prior art method of sensing the field generated by the horizontal deflection in an integrated horizontal deflection and EHT generation circuit will provide some cancellation, improved cancellation can be achieved by sensing the modulation of the CRT anode directly. It is necessary to achieve emission levels of under 1 V/m in order to meet the TCO standard. It is unlikely that such levels can be achieved without eliminating modulations of the CRT final anode voltage.

Unpublished UK Patent Application No. GB9312297.6 describes an open loop active field cancellation system for a CRT display. The system comprises a detection antenna connected via a matching network to the input of an inverting amplifier. The output of the amplifier is connected via a tuning network to a radiating antenna. In operation, the detection antenna detects electric fields radiating from the CRT. The amplifier amplifies and inverts the signal from the detection antenna. The matching network conditions the output from the detection antenna to correct for the amplifier gain and phase characteristics in preparation for application of the inverted signal output from the amplifier to the radiating antenna. A problem with this system is that it requires difficult adjustment during manufacture. Furthermore, in the event of a display fitted with this system requiring a major field service, readjustment may be needed. In addition, the open loop topology of this system limits further reductions in electric field radiation. This is a particularly significant problem because the acceptable electric field emission level may be reduced as research continues. Still furthermore, high precision components are needed to prevent performance degradation with ageing.

SUMMARY OF THE INVENTION

In accordance with the present invention, there is now provided electrical apparatus comprising: antenna means for directing towards an electric field source to detect an electric field radiating from the source; amplifier means connected to the antenna means for generating an output signal in response to an input signal from the antenna means, the output signal being in anti-phase to the input signal; radiator means connected to the amplifier means for radiating a cancelling electric field in anti-phase to the electric field from the source in response to the output signal from the amplifier to at least partially cancel the electric field radiating from the source; wherein the antenna means, when directed towards the source, is positioned relative to the radiator means and the source to detect both the cancelling electric field from the radiator means and the electric field from the source, the input signal produced by the antenna means being derived from the sum of the electric field from the source and the cancelling electric field from the radiator.

Because the input signal is generated by the antenna means as a function of both the electric field to be reduced and the cancelling electric field, the system of the present invention provides negative feedback, closed loop cancellation. The larger the difference between the field to be reduced and the cancelling electric field, the larger the input signal at the input of the amplifier means, and therefore the larger the cancelling electric field propagated from the radiator means. The cancelling electric field therefore tracks the electric field to be reduced as the negative feedback loop tends to reduce the input signal to zero. The input signal is therefore analogous to the error signal of a conventional negative feedback loop. This avoids the requirement for difficult adjustment during manufacture and also ensures optimum cancellation after field service. Furthermore, because the negative feedback loop always operates to minimise the electric field to be reduced, the degree of electric field reduction available is limitless. Still furthermore, the performance of this system will not be degraded by component aging because the loop gain of the system is determined exclusively by the physical location and dimensions of the antenna.

Preferably, the antenna means comprises an electrically conductive plate connected to the input of the amplifier. For simplicity, the amplifier means is preferably located on the radiator means.

In preferred embodiments of the present invention, the antenna means is disposed at least partially between the source and the radiator means. In such embodiments, the radiator means preferably comprises an electrically conductive member at least partially surrounding the source.

In a particularly preferred embodiment of the present invention, the source comprises a cathode ray display tube. The radiator means is preferably located concentrically with the cathode ray tube.

Viewing the present invention from a second aspect, there is now provided a cathode ray tube display comprising: a cathode ray tube; antenna means directed towards the cathode ray tube to detect an electric field radiating from the cathode ray tube; amplifier means connected to the antenna means for generating an output signal in response to an input signal from the antenna means, the output signal being in anti-phase to the input signal; radiator means connected to the amplifier means for radiating a cancelling electric field in anti-phase to the electric field from the cathode ray tube in response to the output signal from the amplifier to at least partially cancel the electric field radiating from the cathode ray tube; wherein the antenna means is positioned relative to the radiator means and the cathode ray tube to detect both the cancelling electric field from the radiator means and the electric field from the cathode ray tube, the input signal produced by the antenna means being derived from the sum of the electric field (E) from the cathode ray tube and the cancelling electric field from the radiator.

Viewing the present invention from a third aspect, there is now provided a method for reducing electric fields radiating from a source, the method comprising: detecting using antenna means the electric field from the source; generating using an inverting amplifier an output signal in response to an input signal from the antenna, the output signal being in anti-phase to the input signal; radiating using radiator means a cancelling electric field in anti-phase to the electric field from the source in response to the output signal from the amplifier to at least partially cancel the electric field from the source; and, summing the electric field from the source and the cancelling electric field from the radiator to produce the input signal by positioning the antenna means relative to the radiator means and the source to detect both the electric field from the source and the cancelling electric field from the radiator means.

In a preferred embodiment of the present invention, the radiator means is located concentrically with the cathode ray tube. The amplifier means is preferably located on the radiator means.

BRIEF DESCRIPTION OF THE DRAWINGS

Preferred embodiments of the present invention will now be described with reference to the accompanying drawings in which.

DETAILED DESCRIPTION OF THE INVENTION

Figure 1:
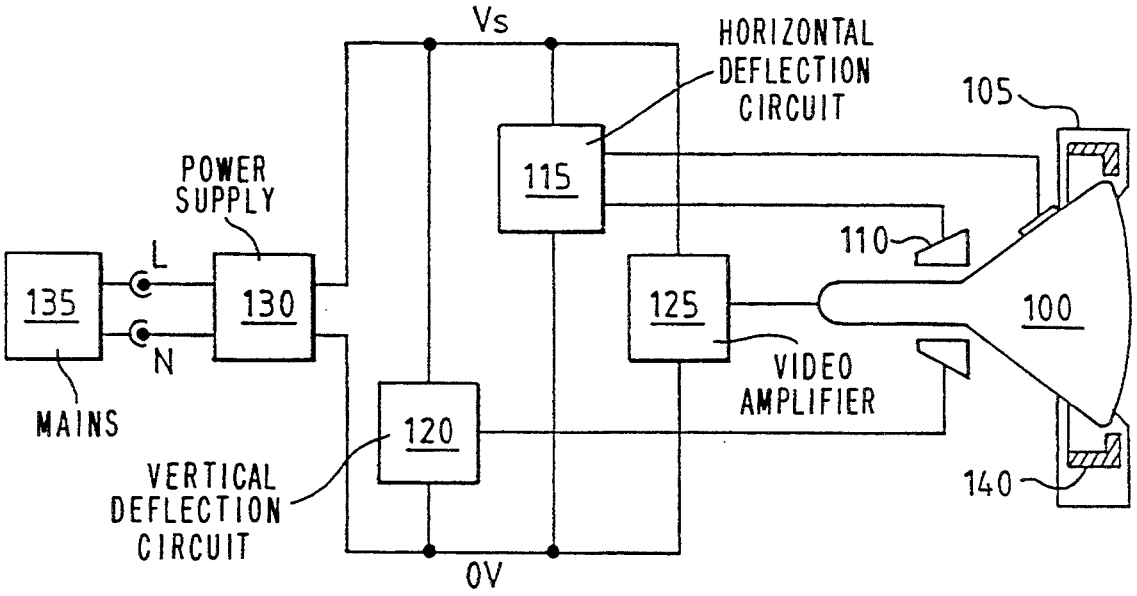
FIG. 1 is a block diagram of a CRT display.

Referring first to FIG. 1, a CRT display comprises a CRT 100 framed in, and supported by a bezel 105. Horizontal and vertical deflection coils are disposed around the neck of the CRT in a yoke 110. In use, the CRT is controlled by a drive circuit. The drive circuit comprises horizontal and vertical scan circuits 115 and 120 connected to the horizontal and vertical deflection coils respectively, a video amplifier 125 connected to the electron gun of the CRT 100, and a power supply 130 for supplying power from the mains at 135 to scan circuits 115 and 120 and video amplifier 125 via supply rails Vs and 0V. Horizontal deflection circuit 115 comprises an integral EHT generator connected to the final anode of CRT 100. In an alternative embodiment, the EHT generator may be separate from the horizontal deflection circuit, but synchronised to the horizontal scan signal. The EHT generator comprises a step up transformer, the output of which is then rectified by high voltage diodes to produce, in conjunction with the CRT capacitance a DC output. A high resistance path to discharge the CRT capacitance (a bleed assembly) is present across the CRT. Not shown in this diagram is a degauss coil for demagnetising the CRT shadow mask. This coil operates generally whenever power is applied to the display. Thermistors, whose resistance depends on temperature are used to cause the resultant current through the degauss coil to decay rapidly from a peak to switch on to a lower value. This lower value should have no visible effect on the screen, but nevertheless there is a residual mains frequency field emitted.

In operation, power supply 130 receives power from the mains at 135. Line and frame scan circuits 115 and 120 generate line and frame sawtooth currents in the horizontal and vertical deflection coils to scan the three electron beams across the CRT screen 100 in a raster pattern. Video amplifier 125 modulates the electron beam intensities with picture information in response to externally supplied red, green, and blue video signals. The sawtooth scan currents are synchronised to the input picture information by externally supplied horizontal and vertical synchronisation signals.

The primary source of radiated electric fields in front of the CRT display of FIG. 1 is the modulation of the internal CRT final anode voltage. This modulation is coupled through the CRT faceplate and transmitted through the intervening medium (air in most cases) to the observation point. The final anode modulation is caused by imperfect voltage regulation when beam current flows. In order to cancel the field from this EHT modulation voltage, the modulation voltage must be sensed and then transmitted in anti-phase by a secondary radiator to cancel the original signal.

Figure 2:
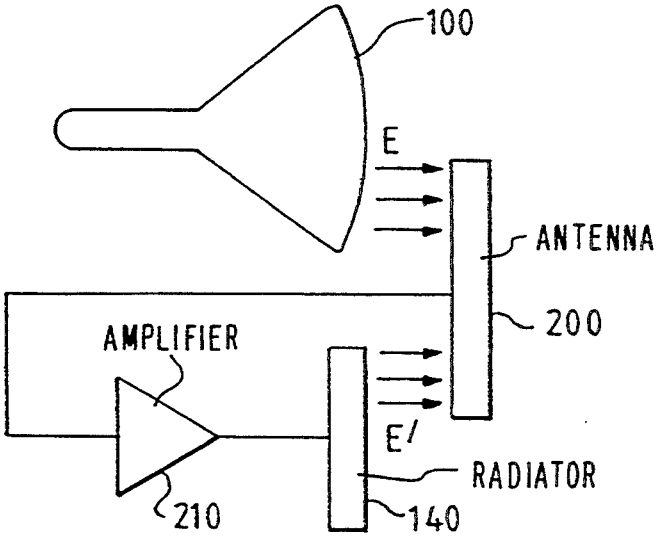
FIG. 2 is a block diagram of a closed loop electric field cancellation apparatus of the present invention.

Referring now to FIG. 2, closed loop electric field cancellation apparatus of the present invention comprises an inverting amplifier 210 having an output connected to a radiator 140. The gain of amplifier 210 is ideally infinity. However, in practise the amplifier gain is very large but finite (typically of the order of $10^5$). The input of amplifier 210 is connected to an antenna 200. CRT 100 is the source of the electric field to be cancelled. Antenna 200 detects the electric field E to be cancelled radiating from CRT 100. The output from the antenna 200 is amplified and inverted by amplifier 210. The output from amplifier 210 causes radiator 140 to emit a cancellation electric field E′ in anti-phase to the electric field E. Antenna 200 is positioned to detect both electric field E from CRT 100 and electric field E′ from the radiator. In accordance with the present invention, antenna 200 acts as a summing junction, effectively adding the electric fields E and E′ to produce an input to amplifier 210. A closed loop negative feedback system for cancelling the electric field E from CRT 100 is thus produced. The input to the system is the electric field E to be cancelled. Negative feedback is provided by detection of the Electric field E′ from radiator 140 by antenna 200. An error signal indicative of the difference between the electric field E and the electric field E′ is produced by antenna 200 at the input of amplifier 210. The error signal is amplified and inverted by amplifier 210 to generate the cancelling electric field E′ from the radiator 140.

The geometry of radiator 140 is crucial to the efficient operation of the system. The primary electric field radiation from the display may be considered as being uniformly transmitted in all directions from the CRT faceplate. To counter this field, radiator 140 is designed to surround the CRT faceplate in order that effective cancellation is space may be achieved without excessive distortion. Minimisation of the nodes and antinodes in the combined wave-fronts propagating though space is then achieved. This is essential if true compliance with, for example, the TCO standard, is to be adhered to. Referring back to FIG. 1, in a preferred embodiment of the present invention, radiator 140 is in the form of a conductive insert in the bezel supporting CRT 100.

Figure 3:
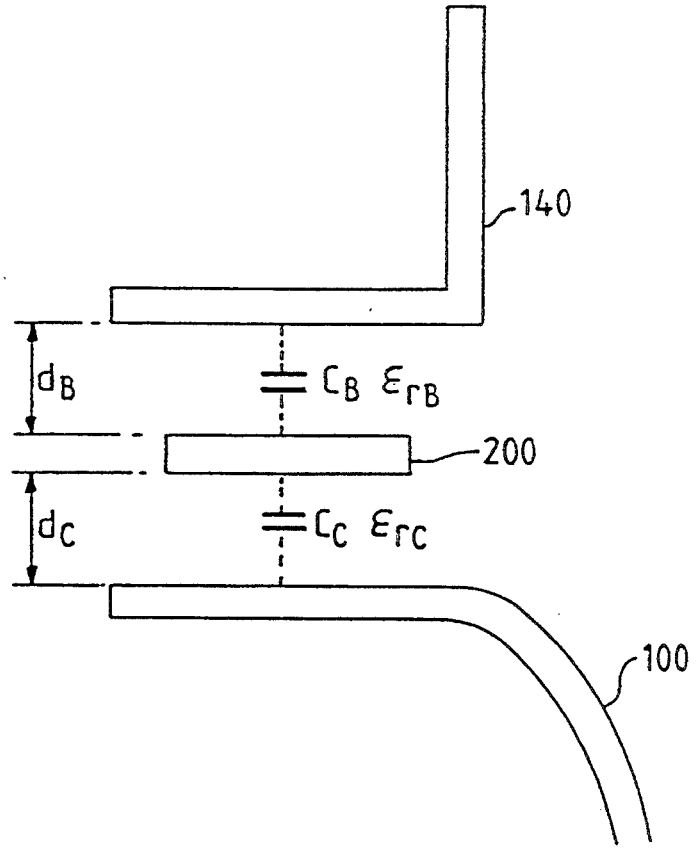
FIG. 3 is a block diagram of a spatial summing junction for the closed loop electric field cancellation apparatus.

To provide optimum cancellation, antenna 200 would ideally be placed in front of CRT 100 at the nominal position of the observer. However, it will be appreciated that this is impractical. Referring to FIG. 3, in a preferred embodiment of the present invention, antenna 200 is in the form of a metal plate located in the bezel and disposed between CRT 100 and radiator 140.

As with any closed loop system, at some point the overall loop gain of the system must be defined. As mentioned earlier, the gain of the amplifier, although ideally infinite, is in practise very large but finite. This sets a lower limit of the field cancellation. An analogous situation exists in conventional closed loop amplifiers circuits where the gain error is inversely proportional to the amplifier open loop gain. As will be shown in the following, the transfer function, and therefore the closed loop gain, of the system of the present invention is determined by the dimensions and positioning of antenna 200 relative to those of radiator 140 and CRT 100. The dimensions and positioning of antenna 200 can be set extremely accurately. This provides the system of the present invention with loop gain tolerance which is superior to that of a conventional amplifier circuit in which resistive elements and/or other passive circuit components dominate the transfer function.

What follows is a mathematical calculation to indicate the importance of the positioning of antenna 200 relative to CRT 100 and radiator 140.

Let the distance between radiator 140 and antenna 200 be $d_b$;

Let the distance between CRT 100 and antenna 200 be $d_c$;

Let the capacitance between radiator 140 and antenna 200 be $C_b$;

Let the capacitance between CRT 100 and antenna 200 be $C_c$;

Let the relative permittivity between radiator 140 and antenna 200 be $\epsilon_{rb}$; and Let the relative permittivity between CRT 100 and antenna 200 be $\epsilon_{rc}$. Suppose, radiator 140 is driven by a time varying voltage signal $V_b = V_2 \sin w_2 t$; and suppose the CRT modulation voltage is a time varying signal $V_c = V_1 \sin w_1 t$.

$$\text{Current } I = \frac{CdV}{dt}, \text{ thus}$$

$$I_c = w_1 C_c V_1 \cos w_1 t \text{ and } I_b = w_2 C_b V_2 \cos w_2 t$$

In antenna 200, the net resultant current will be zero for effective cancellation. Also the time varying waveform is of the same shape but the opposite phase.

Thus $I_c + I_b = 0$ and $w_1 = w_2 = w$.

$\rightarrow wC_cV_1\cos wt + wC_bV_2\cos wt = 0$ $\rightarrow w\cos wt[C_cV_1 + C_bV_2] = 0$ $\rightarrow C_cV_1 = -C_bV_2$.

Now, $C = \frac{\epsilon_o\epsilon_r A}{d}$, where A is the surface area of antenna 200 and $\epsilon_o$ is permittivity of free space, $$\rightarrow \frac{\epsilon_o\epsilon_{rc}AV_1}{d_c} = \frac{\epsilon_o\epsilon_{rb}AV_2}{d_b}$$

$$\rightarrow \frac{\epsilon_{rc}V_1}{d_c} = \frac{\epsilon_{rb}V_2}{d_b}$$

Thus the cancellation is dependent exclusively on the geometry of the assembly and the relative permittivity of the medium on each side of antenna 200. The cancellation is therefore not affected by the electrical tolerances of the electronic circuit devices used to create the anti-phase field.

Figure 4:
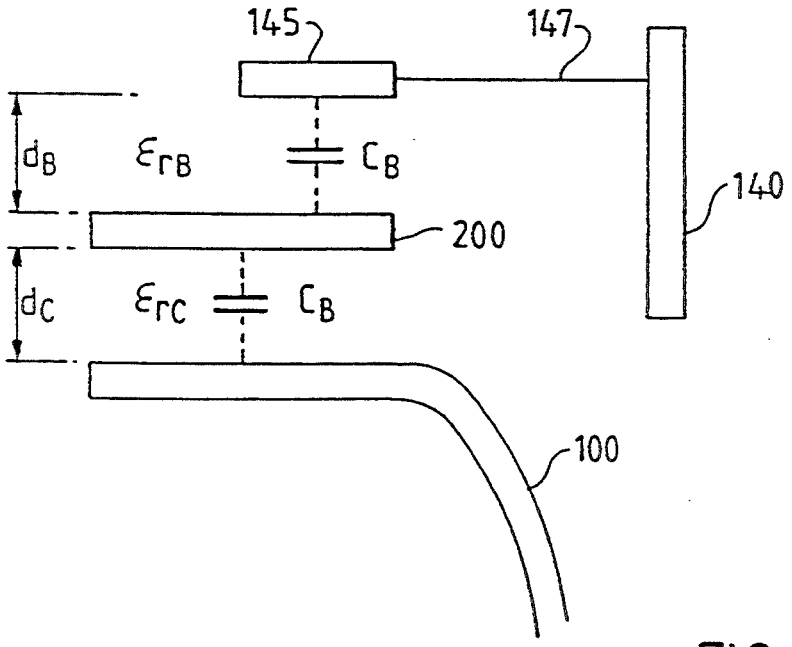
FIG. 4 is a block diagram of another spatial summing junction for the closed loop electric field cancellation apparatus.

Referring now to FIG. 4, in another preferred embodiment of the present invention, antenna 200 is partially covered by sub-radiator 145 connected to radiator 140 via a wire link 147. Where antenna 200 is not completely covered by the adjacent radiating surfaces of CRT 100 and radiator 140 as in the FIG. 4 example, it will be seen that:

$$\frac{\epsilon_o\epsilon_{rc}A_cV_1}{d_c} = \frac{\epsilon_o\epsilon_{rb}A_bV_2}{d_b}$$

$$\rightarrow \frac{\epsilon_{rc}A_cV_1}{d_c} = \frac{\epsilon_{rb}A_bV_2}{d_b}$$

$$\rightarrow V_1 = \frac{\epsilon_{rb}\cdot A_b\cdot d_c}{\epsilon_{rc}A_c d_b}\cdot V_2$$

Thus, the geometry of antenna 200 defines and controls the voltage signal output to radiator 140.

It will be appreciated that in other embodiments of the present invention, the system may include a plurality of interconnected sub-antennae each corresponding to a different sub-radiator. Also, the input to amplifier 200 may be connected to other electrical signal sources in addition to antenna 200 to effect modulation of the cancellation field emitted by radiator 140 by the other electrical signals. In operation, the modulation provides open loop cancellation of electric fields generated by the other electrical signal sources. These may include the clock generator of a touch-sensitive display screen, for example. Meanwhile, the input to amplifier 210 provided by antenna 200 maintains the closed loop cancellation of the unwanted electric field detected by antenna 200.

In the preferred embodiments of the present invention hereinbefore described, amplifier 210 is mounted on the main circuit card of the CRT display. However, in other embodiments of the present invention, amplifier 210 could easily be fitted on radiator 140 to allow the cancellation system of the present invention to become an optional feature for an existing display. No connections between the radiator and the main circuit cards would then be required other than those to provide power to amplifier 210.

Preferred embodiments of the present invention have been hereinbefore described with reference to a colour CRT display. However, it will be appreciated that the present invention is equally applicable to monochrome CRT displays. It will further be appreciated that the present invention is not limited in application to CRT displays and may be applied to other electric field emissive electrical appliances.

An example of apparatus for reducing an electric field radiating from an electric field source 100 in accordance with the present invention has now been described. In the example, the apparatus comprises antenna means 200 for directing towards an electric field source to detect the electric field E to be reduced. The antenna means 200 is connected to amplifier means 210 for generating an output signal in response to an input signal from the antenna means 200. The output signal is in anti-phase to the input signal. Radiator means 140 is connected to the amplifier means 210 for radiating an cancelling electric field E′ in anti-phase to the electric field E from the source 100 in response to the output signal from the amplifier 210 to at least partially cancel reduce the electric field from the source 100. The antenna means 200, when directed towards the source 100, is positioned relative to the radiator means 140 and the source 100 to detect both the cancelling electric field E′ from the radiator means 140 and the electric field E from the source 100. The input signal produced by the antenna means 200 is thus derived from the sum of the electric field E to be reduced from the source 100 and the cancelling electric field E′ from the radiator means 140.

If for any reason, in the examples of the present invention hereinbefore described, the cancellation system fails, there is no inherent indication of the failure to the user, to field service personnel, or to manufacturing operatives because the electric field emissions from the display have no discernable functional effects. Therefore, by way of enhancement, preferred examples of the present invention may be fitted with a sensor circuit for continuously monitoring the performance of the cancellation system. The sensor circuit is adapted to either indicate that the cancellation system is operating correctly or to shut the display down in the event that cancellation system fails. Because the sensor circuit operates continuously whilst the display is powered on, manufacturing operatives can sense a failure condition at their station on the production line and therefore prevent the unit in question from passing further down the line, thereby reducing manufacturing cost.

The wave-form of the electric field emission from the display is complex and varies with screen content. However, one component of the wave-form which is always present is, as mentioned earlier, a scaled down version of the EHT flyback pulse.

Figure 5:
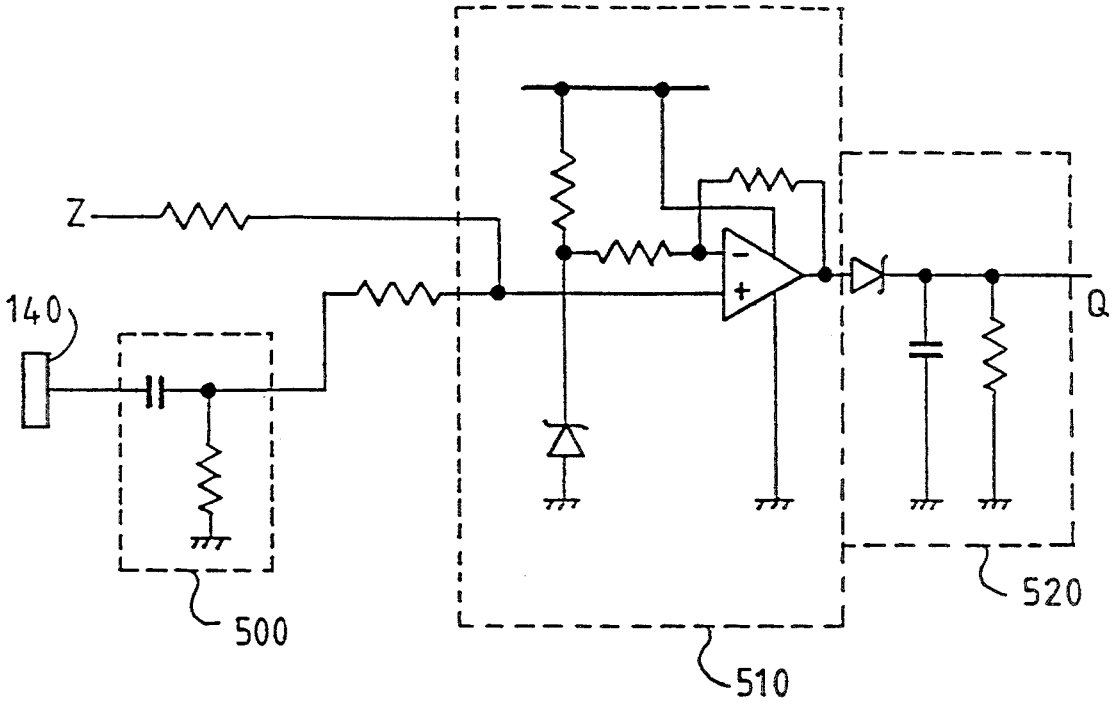
FIG. 5 is a block diagram of a sensor circuit for the cancellation apparatus.

Referring now to FIG. 5, a preferred example of the sensor circuit comprises a filter 500 connected to radiator 140. In operation, filter 500 extracts only the relatively high frequency EHT flyback pulse component from the voltage signal applied to radiator 140. The output of filter 500 is connected to one input of a summing amplifier 510. The other input of summing amplifier 510 is connected to circuit node Z in EHT generator 115 at which, in operation, an inverted, scaled down version of the EHT flyback pulse is present. The two inputs to summing amplifier 510 are therefore in anti-phase. If both the display and cancellation system are operating correctly, the two inputs to summing amplifier 510 sum to a near zero value. Therefore the output of summing amplifier 510 will be low. If, the display is operating correctly but the cancellation system is operating incorrectly (in which antenna 200 may disconnected or earthed, amplifier 210 may be malfunctioning, or radiator 140 may be disconnected for example), the output from filter 500 will be low but the input from node Z will force the output of summing amplifier 510 high. Preferably, the sensor circuit includes thresholding and hysteresis. A peak detector 520 such as a diode pump is connected to the output of summing amplifier 510 to detect and smooth pulses at the output of summing amplifier 510. A zero or negative output from peak detector 520 indicates normal operation and positive output indicates a failure condition. The output of peak detector 520 may be connected to visual indicator such as a light emitting diode or the like to indicate a failure condition to users, field service personnel, or manufacturing operatives. The output of peak detector 520 may also be connected to a latch for shutting down the display in the event of a failure condition arising. During manufacture, the output of peak detector 520 may be sensed by a computer controlled test station to determine whether the cancellation 35 system is operating correctly.

It will be appreciated that such a sensor circuit may be used with a closed loop cancellation system as hereinbefore described or with an open loop cancellation system.

We claim:

1. An electrical apparatus comprising:

an antenna for directing towards an electric field source to detect an electric field (E) radiating from the source;

an amplifier connected to the antenna for generating an output signal in response to an input signal from the antenna, the output signal being in anti-phase to the input signal;

a radiator connected to the amplifier for radiating a cancelling electric field (E′) in anti-phase to the electric field (E) from the source in response to the output signal from the amplifier to at least partially cancel the electric field (E) radiating from the source;

wherein the antenna, when directed towards the source, is positioned relative to the radiator and the source to detect both the cancelling electric field (E′) from the radiator and the electric field from the source, the input signal produced by the antenna being derived from the sum of the electric field (E) from the source and the cancelling electric field (E′) from the radiator.

2. An apparatus, as claimed in claim 1, wherein the antenna comprises an electrically conductive plate connected to the input of the amplifier.

3. An apparatus, as claimed in claim 1, wherein the amplifier is located on the radiator.

4. An apparatus, as claimed in claim 2, wherein the amplifier is located on the radiator.

5. An apparatus, as claimed in claim 1, wherein at least part of the antenna is disposed between the source and the radiator.

6. An apparatus, as claimed in claim 1, wherein all of the antenna is disposed between the source and the radiator.

7. An apparatus, as claimed in claim 5, wherein the radiator comprises an electrically conductive member at least partially surrounding the source.

8. An apparatus, as claimed in claim 6, wherein the radiator comprises an electrically conductive member at least partially surrounding the source.

9. An apparatus, as claimed in claim 5, wherein the source comprises a cathode ray display tube.

10. An apparatus, as claimed in claim 6, wherein the source comprises a cathode ray display tube.

11. An apparatus, as claimed in claim 9, wherein the radiator is located concentrically with the cathode ray tube.

12. An apparatus, as claimed in claim 10, wherein the radiator is located concentrically with the cathode ray tube.

13. An apparatus, as claimed in claim 1, wherein the antenna is a plurality of interconnected sub-antennae and the radiator is a plurality of sub-radiators, each sub-antennae corresponding to a respective sub-radiator.

14. An apparatus, as claimed in claim 1, wherein the source is an electric appliance.

15. An apparatus, as claimed in claim 1, further comprising a sensor circuit for monitoring the cancellation of the electric field from the source.

16. An apparatus, as claimed in claim 15, wherein the sensor circuit indicates if the electric field is being cancelled.

17. An apparatus, as claimed in claim 15, wherein the sensor circuit can shut the source down based on the amount of cancellation of the electric field from the source.

18. A cathode ray tube display comprising:

a cathode ray tube;

antenna directed towards the cathode ray tube to detect an electric field (E) radiating from the cathode ray tube;

amplifier connected to the antenna for generating an output signal in response to an input signal from the antenna, the output signal being in anti-phase to the input signal;

radiator connected to the amplifier for radiating an cancelling electric field (E′) in anti-phase to the electric field (E) from the cathode ray tube in response to the output signal from the amplifier to at least partially cancel the electric field (E) radiating from the cathode ray tube;

wherein the antenna is positioned relative to the radiator and the cathode ray tube to detect both the cancelling electric field (E′) from the radiator and the electric field from the cathode ray tube, the input signal produced by the antenna being derived from the sum of the electric field (E) from the cathode ray tube and the cancelling electric field (E′) from the radiator.

19. A method for reducing an electric field radiating from a source, the method comprising:

detecting using an antenna the electric field (E) from the source;

generating using an inverting amplifier an output signal in response to an input signal from the antenna, the output signal being in anti-phase to the input signal;

radiating using a radiator a cancelling electric field (E′) in anti-phase to the electric field (E) from the source in response to the output signal from the amplifier to at least partially cancel the electric field (E) from the source; and, summing the electric field (E) from the source and the cancelling electric field (E′) from the radiator to produce the input signal by positioning the antenna relative to the radiator and the source to detect both the electric field (E) from the source and the cancelling electric field (E′) from the radiator means.

20. An electrical apparatus comprising:

an electric field source that radiates an electric field (E);

a radiator positioned adjacent to the electric field source for radiating an electric field (E′) in anti-phase to the electric field (E) to at least partially cancel the electric field (E) radiating from the source;

an antenna positioned to receive the electric field (E) radiating from the source and the electric field (E′) radiating from the radiator to produce a cancellation error signal;

an amplifier connected to the antenna for generating a cancellation signal in response to the cancellation error signal, the cancellation signal being in anti-phase to the cancellation error signal; and connecting the cancellation signal of the amplifier to the radiator for driving the radiator to produce the electric field (E′).

21. An electrical apparatus comprising:

a radiator for positioning adjacent to an electric field source radiating an electric field (E) for radiating an electric field (E′) in anti-phase to the electric field (E) to at least partially cancel the electric field (E) radiating from the source;

an antenna for positioning to receive the electric field (E) radiating from the source and the electric field (E′) radiating from the radiator to produce a cancellation error signal;

an amplifier connected to the antenna for generating a cancellation signal in response to the cancellation error signal, the cancellation signal being in anti-phase to the cancellation error signal; and means connecting the cancellation signal of the amplifier to the radiator for driving the radiator to produce the electric field (E′).

* * * * *